US009659693B2

(12) United States Patent
Sakai et al.

(10) Patent No.: US 9,659,693 B2
(45) **Date of Patent: *May 23, 2017**

(54) GRAIN-ORIENTED ELECTRICAL STEEL SHEET AND MANUFACTURING METHOD THEREOF

(71) Applicant: Nippon Steel & Sumitomo Metal Corporation, Tokyo (JP)

(72) Inventors: Tatsuhiko Sakai, Tokyo (JP); Koji Hirano, Tokyo (JP); Satoshi Arai, Tokyo (JP); Yoshiyuki Ushigami, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 362 days.

This patent is subject to a terminal disclaimer.

(21) Appl. No.: 14/276,117

(22) Filed: May 13, 2014

(65) Prior Publication Data

US 2014/0246125 A1 Sep. 4, 2014

Related U.S. Application Data

(63) Continuation of application No. 13/812,229, filed as application No. PCT/JP2010/062679 on Jul. 28, 2010, now Pat. No. 8,790,471.

(51) Int. Cl.

| | |
|---|---|
| ***H01F 1/147*** | (2006.01) |
| ***C21D 8/12*** | (2006.01) |
| ***C21D 10/00*** | (2006.01) |
| ***C22C 38/34*** | (2006.01) |
| ***H01F 1/16*** | (2006.01) |
| ***C21D 8/02*** | (2006.01) |
| ***H01F 1/01*** | (2006.01) |
| ***C21D 9/46*** | (2006.01) |

(52) U.S. Cl.

CPC ..... *H01F 1/14775* (2013.01); *C21D 8/0205* (2013.01); *C21D 8/0278* (2013.01); *C21D 8/12* (2013.01); *C21D 8/1233* (2013.01); *C21D 8/1277* (2013.01); *C21D 9/46* (2013.01); *C21D 10/00* (2013.01); *C22C 38/34* (2013.01); *H01F 1/01* (2013.01); *H01F 1/16* (2013.01); *C21D 2201/05* (2013.01)

(58) Field of Classification Search

CPC ..... H01F 1/01; H01F 1/14775; H01F 1/16; C21D 8/0205; C21D 8/0278; C21D 8/12; C21D 8/1233; C21D 8/1277; C21D 9/46; C21D 10/00; C21D 2201/05; C22C 38/34

See application file for complete search history.

(56) References Cited

U.S. PATENT DOCUMENTS

| | | | | |
|---|---|---|---|---|
| 4,897,131 | A | 1/1990 | Wada et al. | |
| 6,083,326 | A | 7/2000 | Komatsubara et al. | |
| 8,790,471 | B2 * | 7/2014 | Sakai | C21D 8/12 148/307 |

FOREIGN PATENT DOCUMENTS

| | | |
|---|---|---|
| EP | 1607487 | 12/2005 |
| JP | 59-197520 | 11/1984 |
| JP | 60-114519 | 6/1985 |
| JP | 61-75506 | 4/1986 |
| JP | 62-151521 | 7/1987 |
| JP | 63-83227 | 4/1988 |
| JP | 03-079722 | 4/1991 |
| JP | 06-19112 | 3/1994 |
| JP | 07-268474 | 10/1995 |
| JP | 10-183312 | 7/1998 |
| JP | 2006-144058 | 6/2006 |

OTHER PUBLICATIONS

Sato et al., English translation of JP 60-114519, Jun. 1985, p. 1-28.*
International Search Report of Oct. 19, 2010 issued in corresponding PCT Application No. PCT/JP2010/062679.
T. Nozawa, et al., IEEE Transaction on Magnetics, vol. MAG-14 (1978), pp. 252-257.
International Preliminary Report on Patentability of Feb. 21, 2013 issued in corresponding PCT Application No. PCT/JP2010/062679.
Extended European Search Report of Aug. 29, 2013 issued in corresponding EP Application No. 10 85 5300.
Office Action of Oct. 10, 2013 issued in corresponding Chinese Application No. 201080068289.0 [with English Summary of Office Action].

* cited by examiner

*Primary Examiner* — Roy King
*Assistant Examiner* — Caitlin Kiechle
(74) *Attorney, Agent, or Firm* — Birch, Stewart, Kolasch & Birch, LLP

(57) ABSTRACT

A silicon steel sheet (1) containing Si is cold-rolled. Next, a decarburization annealing (3) of the silicon steel sheet (1) is performed so as to cause a primary recrystallization. Next, the silicon steel sheet (1) is coiled so as to obtain a steel sheet coil (31). Next, an annealing (6) of the steel sheet coil (31) is performed through batch processing so as to cause a secondary recrystallization. Next, the steel sheet coil (31) is uncoiled and flattened. Between the cold-rolling and the obtaining the steel sheet coil (31), a laser beam is irradiated a plurality of times at predetermined intervals on a surface of the silicon steel sheet (1) from one end to the other end of the silicon steel sheet (1) along a sheet width direction (2). When the secondary recrystallization is caused, grain boundaries passing from a front surface to a rear surface of the silicon steel sheet (1) along paths of the laser beams are generated.

6 Claims, 8 Drawing Sheets

GRAIN-ORIENTED ELECTRICAL STEEL SHEET AND MANUFACTURING METHOD THEREOF

This application is a continuation application 35 U.S.C. §120 of U.S. Pat. No. 8,790,471, which is a 35 U.S.C. §371 of PCT/JP2010/062679, filed Jul. 28, 2010, each of which is incorporated by reference in its entirety.

TECHNICAL FIELD

The present invention relates to a grain-oriented electrical steel sheet suitable for an iron core of a transformer and the like and a manufacturing method thereof.

BACKGROUND ART

A grain-oriented electrical steel sheet contains Si, and axes of easy magnetization (cubic crystal ((100)<001>) of crystal grains in the steel sheet are substantially parallel to a rolling direction in a manufacturing process of the steel sheet. The grain-oriented electrical steel sheet is excellent as a material of iron core of a transformer and the like. Particularly important properties among magnetic properties of the grain-oriented electrical steel sheet are a magnetic flux density and an iron loss.

There is a tendency that a magnetic flux density of the grain-oriented electrical steel sheet when a predetermined magnetizing force is applied is larger, as the degree in which the axes of easy magnetization of crystal grain are parallel to the rolling direction (which is also referred to as L direction) of the steel sheet is higher, namely, as the matching degree of crystal orientation is higher. As an index for representing the magnetic flux density, a magnetic flux density $B_8$ is generally used. The magnetic flux density $B_8$ is a magnetic flux density generated in the grain-oriented electrical steel sheet when a magnetizing force of 800 A/m is applied in the L direction. Specifically, it can be said that the grain-oriented electrical steel sheet with a large value of the magnetic flux density $B_8$ is more suitable for a transformer having small size and excellent efficiency, since it has a large magnetic flux density generated by a certain magnetizing force.

Further, as an index for representing the iron loss, an iron loss $W_{17/50}$ is generally used. The iron loss $W_{17/50}$ is an iron loss obtained when the grain-oriented electrical steel sheet is subjected to AC excitation under conditions where the maximum magnetic flux density is 1.7 T, and a frequency is 50 Hz. It can be said that the grain-oriented electrical steel sheet with a small value of the iron loss $W_{17/50}$ is more suitable for a transformer, since it has a small energy loss. Further, there is a tendency that the larger the value of the magnetic flux density $B_8$, the smaller the value of the iron loss $W_{17/50}$. Therefore, it is effective to improve the orientation of crystal grains also for reducing the iron loss $W_{17/50}$.

Generally, the grain-oriented electrical steel sheet is manufactured in the following manner. A material of silicon steel sheet containing a predetermined amount of Si is subjected to hot-rolling, annealing, and cold-rolling, so as to obtain a silicon steel sheet with a desired thickness. Then, the cold-rolled silicon steel sheet is annealed. Through this annealing, a primary recrystallization occurs, resulting in that crystal grains in a so-called Goss orientation in which axes of easy magnetization are parallel to the rolling direction (Goss-oriented grains, crystal grain size: 20 μm to 30 μm) are formed. This annealing is performed also as a decarburization annealing. Thereafter, an annealing separating agent containing MgO as its major constituent is coated on a surface of the silicon steel sheet after the occurrence of primary recrystallization. Subsequently, the silicon steel sheet coated with the annealing separating agent is coiled to produce a steel sheet coil, and the steel sheet coil is subjected to an annealing through batch processing. Through this annealing, a secondary recrystallization occurs, and a glass film is formed on the surface of the silicon steel sheet. When the secondary recrystallization occurs, due to an influence of inhibitor included in the silicon steel sheet, the crystal grains in the Goss orientation preferentially grow, and a large crystal grain has a crystal grain size of 100 mm or more. Then, an annealing is performed for flattening the silicon steel sheet after the occurrence of secondary recrystallization, a formation of insulating film and the like, while uncoiling the steel sheet coil.

Almost all of the orientations of respective crystal grains of the grain-oriented electrical steel sheet manufactured through such a method are determined when the secondary recrystallization occurs. FIG. 1A is a diagram illustrating orientations of crystal grains obtained through the secondary recrystallization. As described above, when the secondary recrystallization occurs, crystal grains 14 in the Goss orientation, in which a direction 12 of the axis of easy magnetization matches a rolling direction 13, preferentially grow. At this time, if the silicon steel sheet is not flat and is coiled, a tangential direction of a periphery of the steel sheet coil matches the rolling direction 13. Meanwhile, the crystal grains 14 do not grow in accordance with curvature of the coiled steel sheet surface but grow while maintaining a linearity of the crystal orientation in the crystal grains 14, as illustrated in FIG. 1A. For this reason, when the steel sheet coil is uncoiled and flattened after the occurrence of secondary recrystallization, a part in which the direction 12 of the axis of easy magnetization is not parallel to the surface of the grain-oriented electrical steel sheet is generated in a large number of crystal grains 14. In short, an angle deviation β between the axis of easy magnetization direction (cubic crystal (100)<001>) of each crystal grain 14 and the rolling direction is increased. When the angle deviation β is increased, the matching degree of crystal orientation is decreased, and the magnetic flux density $B_8$ is decreased.

Further, the larger the crystal grain size, the more significant the increase in the angle deviation β. In recent years, because of strengthening of inhibitors and the like, it is possible to facilitate a selective growth of crystal grains in the Goss orientation, and in a crystal grain having a large size in the rolling direction in particular, the decrease in the magnetic flux density $B_8$ is significant.

Further, various techniques have been conventionally proposed for the purpose of improving the magnetic flux density, reducing the iron loss or the like. However, with the conventional techniques, it is difficult to achieve the improvement in the magnetic flux density and the reduction in the iron loss, while maintaining high productivity.

CITATION LIST

Patent Literature

Patent Literature 1: Japanese Laid-open Patent Publication No. 07-268474

Patent Literature 2: Japanese Laid-open Patent Publication No. 60-114519

Patent Literature 3: Japanese Examined Patent Application Publication No. 06-19112

Patent Literature 4: Japanese Laid-open Patent Publication No. 61-75506

Patent Literature 5: Japanese Laid-open Patent Publication No. 10-183312

Patent Literature 6: Japanese Laid-open Patent Publication No. 2006-144058 NON-PATENT LITERATURE Non-Patent Literature 1: T. Nozawa, et al., IEEE Transaction on Magnetics, Vol. MAG-14 (1978) P252-257

SUMMARY OF INVENTION

Technical Problem

The present invention has an object to provide a grain-oriented electrical steel sheet and a manufacturing method thereof capable of improving a magnetic flux density and reducing an iron loss, while maintaining high productivity.

Solution to Problem

As a result of earnest studies, the present inventors have devised various aspects described below.

(1) A manufacturing method of a grain-oriented electrical steel sheet, including:

cold-rolling a silicon steel sheet containing Si;

next, performing a decarburization annealing of the silicon steel sheet so as to cause a primary recrystallization;

next, coiling the silicon steel sheet so as to obtain a steel sheet coil;

next, performing an annealing of the steel sheet coil through batch processing so as to cause a secondary recrystallization; and next, uncoiling and flattening the steel sheet coil, wherein the manufacturing method further comprising, between the cold-rolling the silicon steel sheet containing Si and the coiling the silicon steel sheet so as to obtain the steel sheet coil, irradiating a laser beam a plurality of times at a predetermined interval in a rolling direction on a surface of the silicon steel sheet from one end to the other end of the silicon steel sheet along a sheet width direction, and while the secondary recrystallization is caused, grain boundaries passing from a front surface to a rear surface of the silicon steel sheet are generated along paths of the laser beams.

(2) The manufacturing method of a grain-oriented electrical steel sheet according to (1), wherein a part of the surface of the silicon steel sheet to which the laser beam has been irradiated is flat.

(3) The manufacturing method of a grain-oriented electrical steel sheet according to (1) or (2), wherein the predetermined interval is set based on a radius of curvature of the silicon steel sheet in the steel sheet coil.

(4) The manufacturing method of a grain-oriented electrical steel sheet according to any one of (1) to (3), wherein, when a radius of curvature at an arbitrary position in the silicon steel sheet in the steel sheet coil is R (mm) and the predetermined interval at the position is PL (mm), the following relation is satisfied, $$PL \leq 0.13 \times R.$$

(5) The manufacturing method of a grain-oriented electrical steel sheet according to (4), wherein the predetermined interval is fixed.

(6) The manufacturing method of a grain-oriented electrical steel sheet according to (4), wherein the predetermined interval is wider as the position approaches from an inner surface toward an outer surface of the steel sheet coil.

(7) The manufacturing method of a grain-oriented electrical steel sheet according to any one of (1) to (6), wherein the predetermined interval is 2 mm or more.

(8) The manufacturing method of a grain-oriented electrical steel sheet according to any one of (1) to (7), wherein, when an average intensity of the laser beam is P (W), a size in the rolling direction of a focused beam spot of the laser beam is D1 (mm), a scanning rate in the sheet width direction of the laser beam is Vc (mm/s), and an irradiation energy density of the laser beam is $Up=4/\pi \times P/(Dl \times Vc)$, the following relation is satisfied, $$5\ J/mm^2 \leq Up \leq 20 J/mm^2.$$

(9) The manufacturing method of the grain-oriented electrical steel sheet according to any one of (1) to (8), wherein, when an average intensity of the laser beam is P (W), a size in the rolling direction and a size in the sheet width direction of a focused beam spot of the laser beam are Dl (mm) and Dc (mm), respectively, and a local power density of the laser beam is $Ip=4/\pi \times P/(Dl \times Dc)$, the following relation is satisfied, $$Ip \leq 100\ kW/mm^2.$$

(10) A grain-oriented electrical steel sheet, including grain boundaries passing from a front surface to a rear surface of the grain-oriented electrical steel sheet along paths of laser beams scanned from one end to the other end of the grain-oriented electrical steel sheet along a sheet width direction, wherein, when a sheet thickness direction of an angle made by a rolling direction of the grain-oriented electrical steel sheet and a direction of an axis of easy magnetization direction (100)<001>of each crystal grain is β(°), a value of β at a position separated by 1 mm from the grain boundary is 7.3° or less.

(11) The grain-oriented electrical steel sheet according to (10), wherein a surface of a base material along the grain boundary is flat.

Advantageous Effects of Invention

According to the present invention, an angle deviation can be lowered by grain boundaries which are created along paths of laser beams and which pass from a front surface to a rear surface of a silicon steel sheet, so that it is possible to improve a magnetic flux density and to reduce an iron loss while maintaining high productivity.

DESCRIPTION OF EMBODIMENTS

Figure 2A:
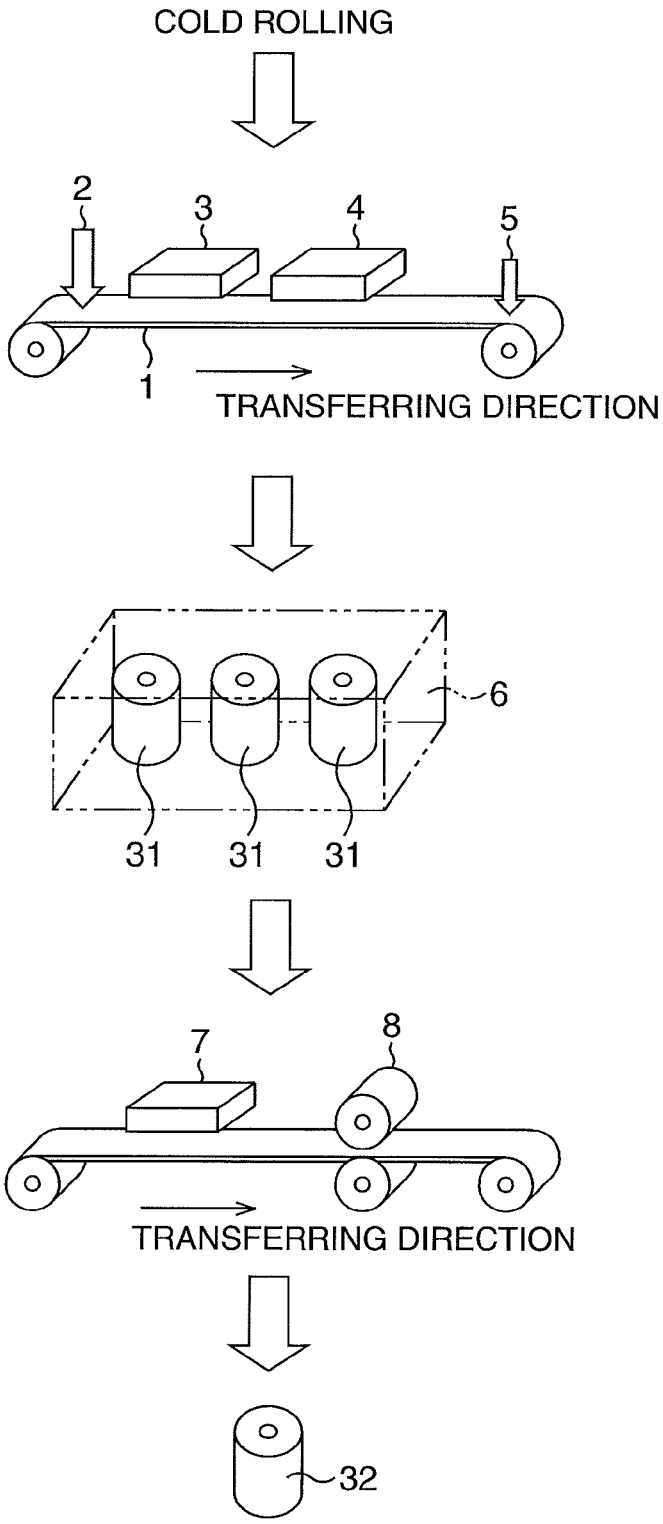
FIG. 2A is a diagram illustrating a manufacturing method of a grain-oriented electrical steel sheet according to an embodiment of the present invention.

Hereinafter, an embodiment of the present invention will be described while referring to the accompanying drawings. FIG. 2A is a diagram illustrating a manufacturing method of a grain-oriented electrical steel sheet according to an embodiment of the present invention.

In the present embodiment, cold-rolling of a silicon steel sheet 1 containing Si of, for example, 2 mass % to 4 mass % is performed, as illustrated in FIG. 2A. This silicon steel sheet 1 may be produced through continuous casting of molten steel, hot-rolling of a slab obtained through the continuous casting, an annealing of a hot-rolled steel sheet obtained through the hot-rolling, and so on. A temperature at the time of the annealing is about 1100° C., for example. Further, a thickness of the silicon steel sheet 1 after the cold-rolling may be set to about 0.20 mm to 0.3 mm, for example, and the silicon steel sheet 1 after the cold-rolling is coiled so as to be formed as a cold-rolled coil, for example.

Then, the coil-shaped silicon steel sheet 1 is supplied to a decarburization annealing furnace 3 while being uncoiled, and subjected to an annealing in the annealing furnace 3. A temperature at the time of the annealing is set to 700° C. to 900° C., for example. During the annealing, a decarburization occurs, and a primary recrystallization occurs resulting in that crystal grains in a Goss orientation, in which axes of easy magnetization are parallel to the rolling direction, are formed. Thereafter, the silicon steel sheet 1 discharged from the decarburization annealing furnace 3 is cooled with a cooling apparatus 4. Subsequently, a coating 5 of an annealing separating agent containing MgO as its major constituent is performed on a surface of the silicon steel sheet 1. Further, the silicon steel sheet 1 coated with the annealing separating agent is coiled with a predetermined inner radius R1 to be formed as a steel sheet coil 31.

Figure 2B:
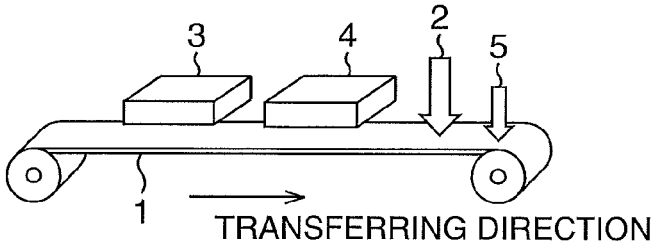
FIG. 2B is a diagram illustrating a modified example of the embodiment.

Further, in the present embodiment, between the uncoiling the coil-shaped silicon steel sheet 1 and the supplying it to the decarburization annealing furnace 3, a laser beam is irradiated a plurality of times at predetermined intervals in the rolling direction on a surface of the silicon steel sheet 1 from one end to the other end of the silicon steel sheet 1 along a sheet width direction with a laser beam irradiation apparatus 2. Incidentally, as illustrated in FIG. 2B, the laser beam irradiation apparatus 2 may be disposed on a downstream side in a transferring direction of the cooling apparatus 4, and the laser beams may be irradiated to the surface of the silicon steel sheet 1 between the cooling with the cooling apparatus 4 and the coating 5 of the annealing separating agent. Further, the laser beam irradiation apparatus 2 may be disposed on both of an upstream side in the transferring direction of the annealing furnace 3 and a downstream side in the transferring direction of the cooling apparatus 4, and the laser beams may be irradiated with both of the apparatuses. Furthermore, the irradiation of laser beam may be conducted between the annealing furnace 3 and the cooling apparatus 4, and the irradiation may be conducted in the annealing furnace 3 or in the cooling apparatus 4.

Figure 3A:
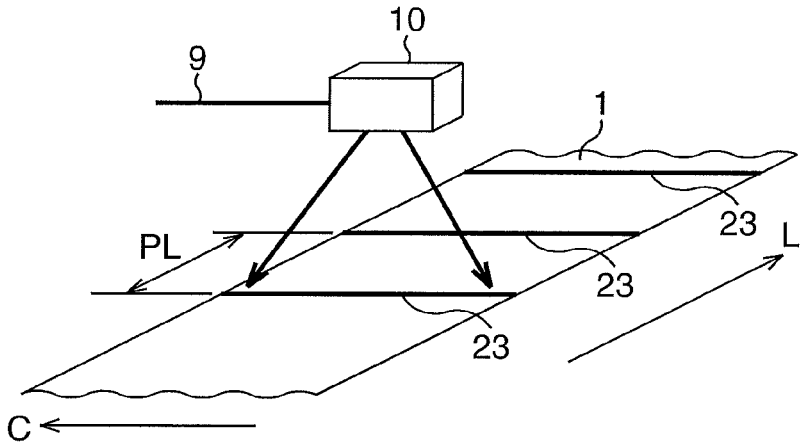
FIG. 3A is a diagram illustrating an example of a method of scanning laser beams.

Incidentally, the irradiation of laser beam may be performed by a scanner 10 when it scans a laser beam 9 radiated from a light source (laser) at a predetermined interval PL in the sheet width direction (C direction) substantially perpendicular to the rolling direction (L direction) of the silicon steel sheet 1, as illustrated in FIG. 3A, for example. As a result of this, paths 23 of the laser beams 9 remain on the surface of the silicon steel sheet 1, regardless of whether they can be visually recognized or not. The rolling direction substantially matches the transferring direction.

Figure 3B:
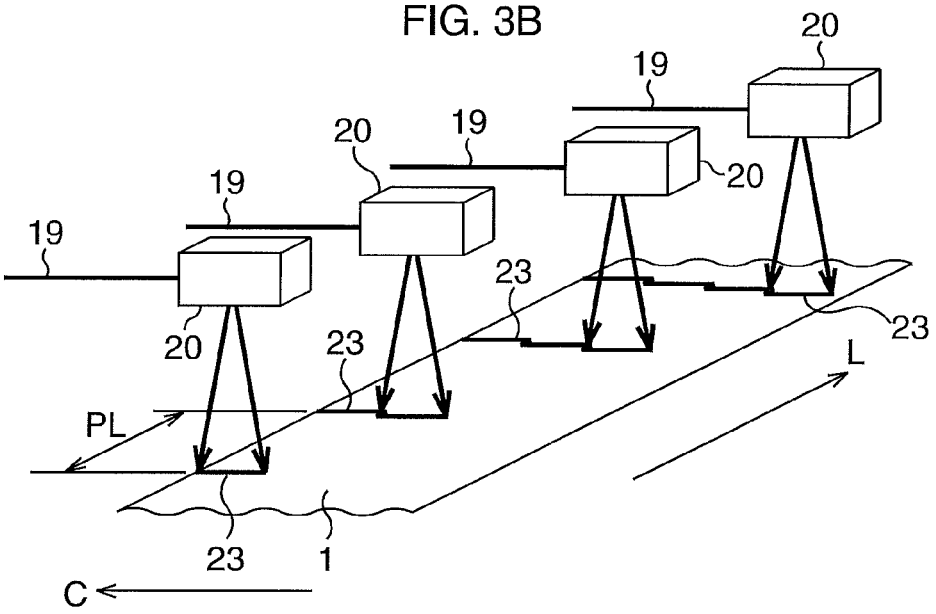
FIG. 3B is a diagram illustrating another example of the method of scanning laser beams.

Further, the scanning of laser beams over the entire width of the silicon steel sheet 1 may be performed with one scanner 10, or with a plurality of scanners 20 as illustrated in FIG. 3B. When the plurality of scanners 20 are used, only one light source (laser) of laser beams 19, which are incident on the respective scanners 20, may be provided, or one light source may be provided for each scanner 20. When the number of light source is one, a laser beam radiated from the light source may be split to form the laser beams 19. If the scanners 20 are used, it is possible to divide an irradiation region into a plurality of regions in the sheet width direction, so that it is possible to reduce a period of time of scanning and irradiation required per one laser beam. Therefore, using the scanners 20 is particularly suitable for a high-speed transferring facility.

Figure 4A:
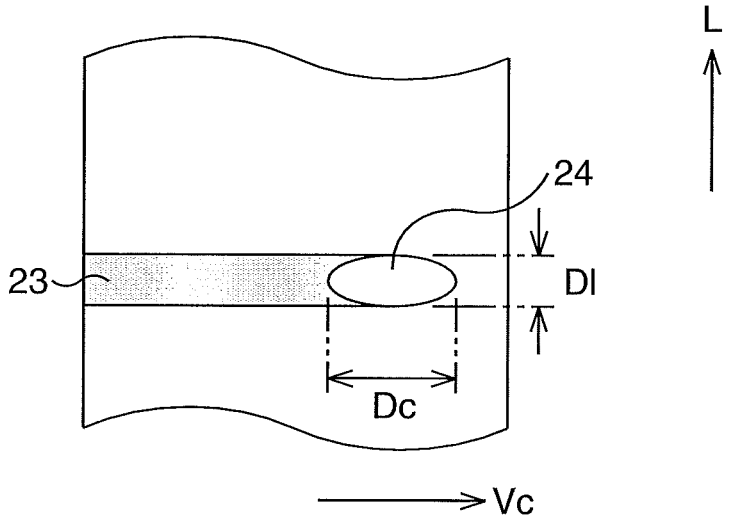
FIG. 4A is a plan view illustrating a light spot.
Figure 4B:
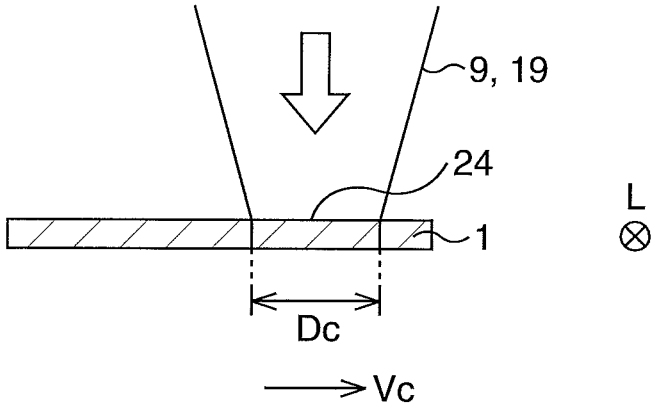
FIG. 4B is a sectional view illustrating the light spot.

The laser beam 9 or 19 is focused by a lens in the scanner 10 or 20. As illustrated in FIG. 4A and FIG. 4B, a shape of a light spot 24 of the laser beam 9 or 19 on the surface of the silicon steel sheet 1 may have a circular shape or an elliptical shape with a diameter in the sheet width direction (C direction) of Dc and a diameter in the rolling direction (L direction) of Dl. Further, the scanning of laser beam 9 or 19 may be performed at a rate Vc with a polygon mirror in the scanner 10 or 20, for example. The diameter in the sheet width direction (diameter in the C direction) Dc may be set to 5 mm, the diameter in the rolling direction (diameter in the L direction) Dl may be set to 0.1 mm, and the scanning rate Vc may be set to about 1000 mm/s, for example.

Incidentally, as the light source (laser device), a $CO_2$ laser may be used, for example. Further, a high-power laser which is generally used for industrial purposes such as a YAG laser, semiconductor laser, and a fiber laser may be used.

Further, a temperature of the silicon steel sheet 1 during irradiating the laser beam is not particularly limited, and the irradiation of laser beam may be performed on the silicon steel sheet 1 at about room temperature, for example. Further, the direction in which the laser beam is scanned does not have to coincide with the sheet width direction (C direction), but, from the viewpoint of working efficiency and the like and from a point in which a magnetic domain is refined into long strip shapes along the rolling direction, a deviation of the direction from the sheet width direction (C direction) is preferably within 45°, more preferably within 20°, and even more preferably within 10°.

Details of the irradiation interval PL of laser beam will be described later.

After the coating 5 of the annealing separating agent and the coiling, the steel sheet coil 31 is conveyed into an annealing furnace 6, and is placed with a center axis of the steel sheet coil 3 set substantially in a vertical direction, as illustrated in FIG. 2A. Then, an annealing (finish annealing) of the steel sheet coil 31 is performed through batch processing. The maximum attained temperature and a period of time at the time of this annealing are set to about 1200° C. and about 20 hours, respectively, for example. During this annealing, a secondary recrystallization occurs, and a glass film is formed on the surface of the silicon steel sheet 1. Thereafter, the steel sheet coil 31 is taken out from the annealing furnace 6.

Subsequently, the steel sheet coil 31 is supplied, while being uncoiled, to an annealing furnace 7, and is subjected to an annealing in the annealing furnace 7. During this annealing, a curl, distortion and deformation occurred during the finish annealing are eliminated, resulting in that the silicon steel sheet 1 becomes flat. Then, a formation 8 of a film on the surface of the silicon steel sheet 1 is performed. As the film, one capable of securing insulation performance and imposing a tension for reducing the iron loss may be formed, for example. Through these series of processing, a grain-oriented electrical steel sheet 32 is manufactured. After the formation 8 of the film, the grain-oriented electrical steel sheet 32 may be coiled for the convenience of storage, conveyance and the like, for example.

Figure 5A:
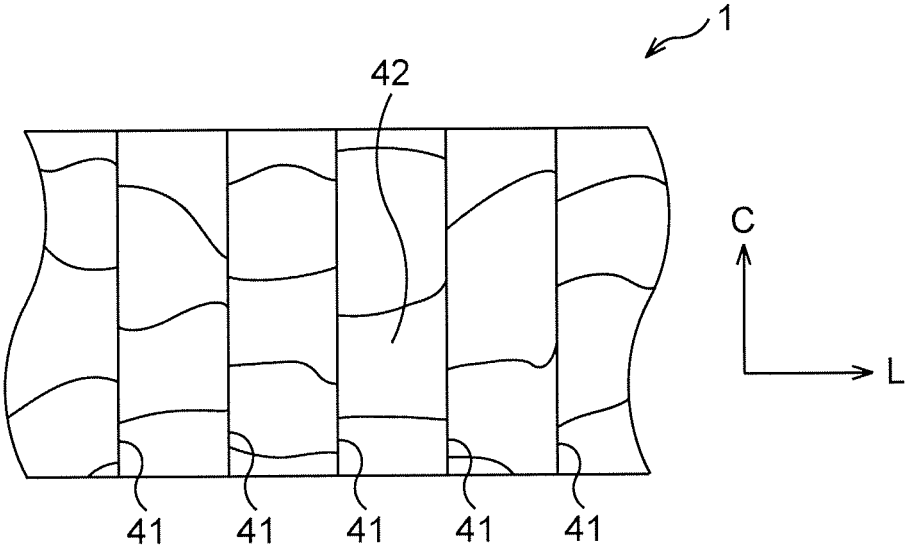
FIG. 5A is a plan view illustrating grain boundaries generated in the embodiment of the present invention.
Figure 5B:
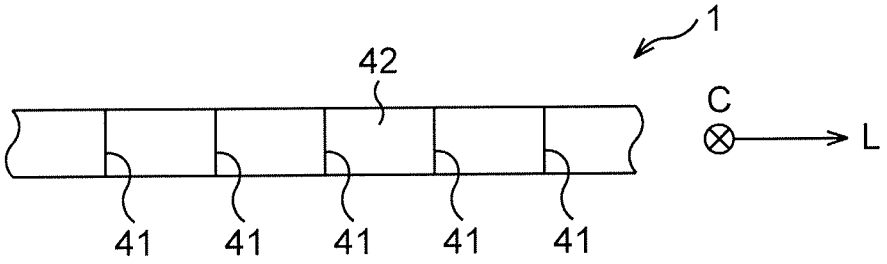
FIG. 5B is a sectional view illustrating the grain boundaries generated in the embodiment of the present invention.

When the grain-oriented electrical steel sheet 32 is manufactured through such a method, during the secondary recrystallization, grain boundaries 41 are created which pass from a front surface to a rear surface of the silicon steel sheet 1 beneath the paths 23 of laser beams, as illustrated in FIG. 5A and FIG. 5B.

It may be considered that the reason why such a grain boundary 41 is generated is because internal stress and distortion are introduced by the rapid heating and cooling caused due to the irradiation of laser beam. Further, it may also be considered that due to the irradiation of laser beam the size of crystal grains obtained through the primary recrystallization differs from that of surrounding crystal grains, resulting in that the grain growth rate during the secondary recrystallization differs, and the like.

Figure 6A:
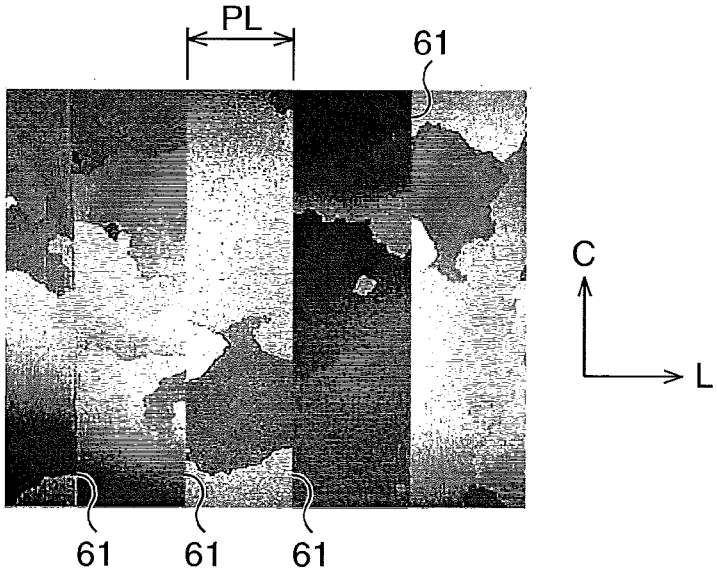
FIG. 6A is a diagram illustrating a picture of a surface of a silicon steel sheet obtained when an irradiation of laser beam is performed.
Figure 6B:
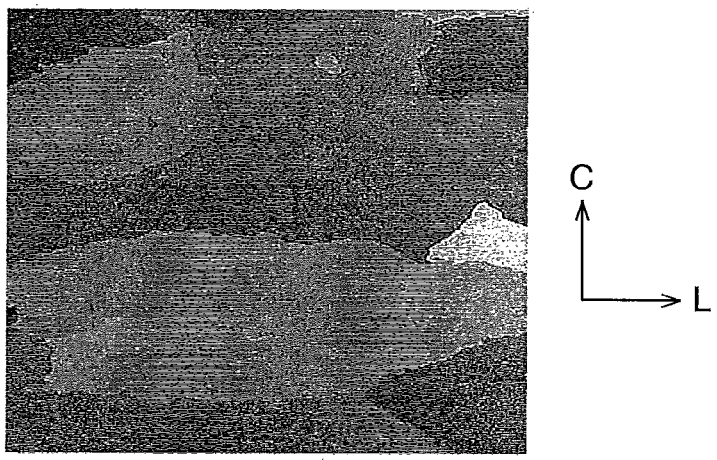
FIG. 6B is a diagram illustrating a picture of a surface of a silicon steel sheet obtained when the irradiation of laser beam is omitted.
Figure 7:
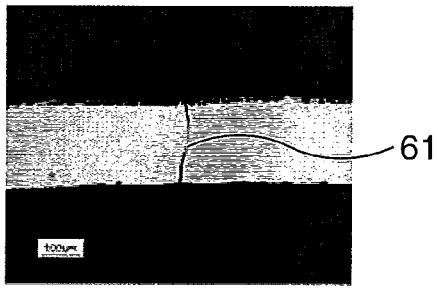
FIG. 7 is a diagram illustrating a picture of cross section of the silicon steel sheet obtained when the irradiation of laser beam is performed.

Actually, when a grain-oriented electrical steel sheet was manufactured based on the above-described embodiment, grain boundaries illustrated in FIG. 6A and FIG. 7 were observed. These grain boundaries included grain boundaries 61 formed along paths of laser beams. Further, when a grain-oriented electrical steel sheet was manufactured based on the above-described embodiment except that the irradiation of laser beam was omitted, a grain boundary illustrated in FIG. 6B was observed.

FIG. 6A and FIG. 6B are pictures photographed after a glass film and the like were removed from surfaces of the grain-oriented electrical steel sheets to expose the base material of steel, and then a pickling of the surfaces was followed. In these pictures, crystal grains and grain boundaries obtained through the secondary recrystallization appear. Further, regarding the manufacture of the grain-oriented electrical steel sheets set as targets of photographing of the pictures, an inner radius and an outer radius of each of steel sheet coils were set to 300 mm and 1000 mm, respectively. Further, the irradiation interval PL of laser beam was set to about 30 mm. Further, FIG. 7 illustrates a cross section perpendicular to the sheet width direction (C direction).

When the grain-oriented electrical steel sheet illustrated in FIG. 6A and FIG. 7 was observed in detail, a length in the rolling direction (L direction) of crystal grain was about 30 mm, at maximum, which corresponds to the irradiation interval PL. Further, change in shape such as a groove was rarely confirmed on a part to which the laser beam was irradiated, and a surface of base material of the grain-oriented electrical steel sheet was substantially flat. Moreover, in both cases where the irradiation of laser beam was conducted before the annealing with the annealing furnace 3, and the irradiation was conducted after the annealing, similar grain boundaries were observed.

The present inventors conducted detailed examination regarding an angle deviation β of the grain-oriented electrical steel sheet manufactured along the aforementioned embodiment. In this examination, crystal orientation angles of various crystal grains were measured by an X-ray Laue method. A spatial resolution of the X-ray Laue method, namely, a size of X-ray spot on the grain-oriented electrical steel sheet was about 1 mm. This examination showed that any of the angle deviations β at various measurement positions in the crystal grains divided by grain boundaries extending along paths of laser beams was within a range of 0° to 6°. This means that a very high matching degree of crystal orientation was obtained.

Meanwhile, the grain-oriented electrical steel sheet manufactured by omitting the irradiation of laser beam included a large number of crystal grains each having a size in the rolling direction (L direction) larger than that obtained when performing the irradiation of laser beam. Further, when the examination of angle deviation β was performed on such large crystal grains, through the X-ray Laue method, the angle deviation β exceeded 6° on the whole, and further, the maximum value of the angle deviation β exceeded 10° in a large number of crystal grains.

Here, explanation will be made on the irradiation interval PL of laser beam.

The relation between the magnetic flux density $B_8$ and the magnitude of the angle deviation β is according to Non-Patent Literature 1, for example. The present inventors experimentally obtained measurement data similar to the relation according to Non-Patent Literature 1, and obtained, from the measurement data, a relation between the magnetic flux density $B_8$ (T) and β (°) represented by an expression (1) through the least-squares method.

$$B_8=-0.026\times\beta+2.090 \quad (1)$$

Figure 8:
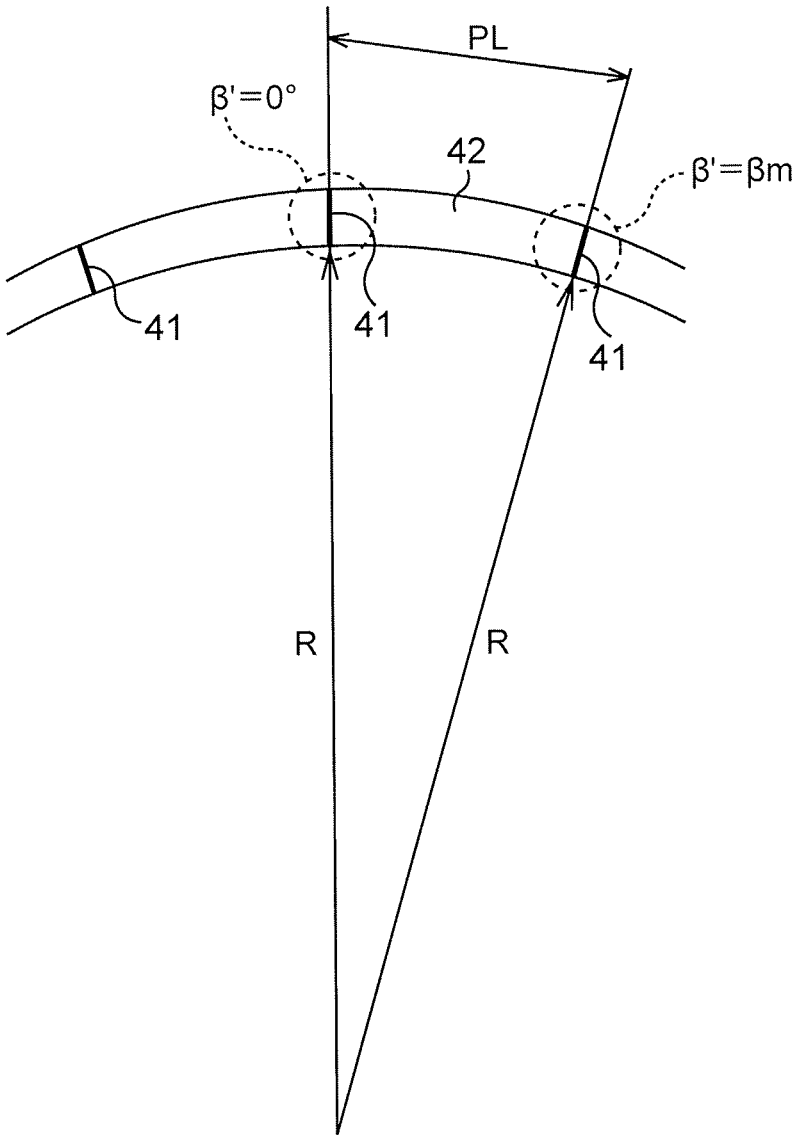
FIG. 8 is a diagram illustrating a relation between a grain boundary and an angle deviation β.

Meanwhile, as illustrated in FIG. 5A, FIG. 5B and FIG. 8, there exists at least one crystal grain 42 between two grain boundaries 41 along paths of laser beams. Here, attention is focused on one crystal grain 42, in which an angle deviation at each position in the crystal grain 42 is defined as β', by setting a crystal orientation in an end portion on one side of the two grain boundaries 41 of the crystal grain 42 as a reference. At this time, as illustrated in FIG. 8, the angle deviation β' at the end portion on the one side is 0°. Further, at the end portion on the other side, the maximum angle deviation in the crystal grain 42 is generated. Here, this angle deviation is expressed as the maximum angle deviation βm (β'=βm). In this case, the maximum angle deviation βm is represented as an expression (2) with an interval PL between the grain boundaries 41, namely, a length Lg in the rolling direction of the crystal grain 42, and a radius of curvature R of the silicon steel sheet at the position in the steel sheet coil in the finish annealing. Incidentally, a thickness of the silicon steel sheet is thin so that it is negligible compared to the inner radius and the outer radius of the steel sheet coil. For this reason, there is no difference, almost at all, between the radius of curvature of the surface on the inside of the steel sheet coil and the radius of curvature of the surface on the outside of the steel sheet coil, and thus there is no influence, almost at all, on the maximum angle deviation Om, even if either value is used as the radius of curvature R.

$$\beta m=(180/\pi)\times(Lg/R) \quad (2)$$

When attention is focused on the expression (1), it can be understood that when the angle deviation β is 7.3° or less, the magnetic flux density $B_8$ of 1.90 T or more can be obtained. Conversely, it can be said that it is important to set the angle deviation β to 7.3° or less for obtaining the magnetic flux density $B_8$ of 1.90 T or more. Further, when attention is focused on the expression (2), it can be said that, in order to set the maximum angle deviation βm to 7.3° or less, namely, in order to obtain the magnetic flux density $B_8$ of 1.90 T or more, it is important to satisfy the following expression (3).

$$Lg\leq 0.13\times R \quad (3)$$

From these relations, it can be said that regarding a part of the silicon steel sheet in which the radius of curvature in the steel sheet coil is "R", when the length Lg in the rolling direction of the crystal grain grown in that part satisfies the expression (3), the maximum angle deviation βm becomes 7.3° or less, and the magnetic flux density $B_8$ of 1.90 T or more can be obtained. Further, the length Lg corresponds to the irradiation interval PL of laser beam. Therefore, it can be said that by setting, at an arbitrary position in the silicon steel sheet, the irradiation interval PL of laser beam to satisfy an expression (4) in accordance with the radius of curvature R, it is possible to obtain a high magnetic flux density $B_8$.

$$PL\leq 0.13\times R \quad (4)$$

Further, even before the steel sheet coil is obtained, the radius of curvature R in the steel sheet coil of each part of the silicon steel sheet can be easily calculated from information regarding the length in the rolling direction of the silicon steel sheet, the set value of the inner radius of the steel sheet coil, a position Ps of the part by setting a front edge or a rear edge of the silicon steel sheet as a reference, and the like.

Further, when attention is focused on the expression (1) and the expression (2), it is important to set the angle deviation β to 5.4° or less for obtaining the magnetic flux density $B_8$ of 1.95 T or more, and to realize that, it is important to set the irradiation interval PL of laser beam to satisfy an expression (5).

$$PL\leq 0.094\times R \quad (5)$$

Here, explanation will be made on an example of method of adjusting the irradiation interval PL in accordance with the radius of curvature R. Specifically, in this method, the irradiation interval PL is not fixed, and is adjusted to suitable one in accordance with the radius of curvature R. As described above, the inner radius R1 when coiling the silicon steel sheet 1 after the coating 5 of the annealing separating agent is performed, namely, the inner radius R1 of the steel sheet coil 31 is predetermined. The outer radius R2 and a coiling number N of the steel sheet coil 31 can be easily calculated from a size Δ of gap existed between silicon steel sheets 1 within the steel sheet coil 31, a thickness t of the silicon steel sheet 1, a length L0 in the rolling direction of the silicon steel sheet 1, and the inner radius R1. Further, from values of these, it is possible to calculate the radius of curvature R in the steel sheet coil 31 of each part of the silicon steel sheet 1 as a function of a distance L1 from the front edge in the transferring direction. Incidentally, as the size Δ of gap, an experientially obtained value, a value based on the way of coiling or the like may be used, and a value of 0 or a value other than 0 may be used. Further, the radius of curvature R may be calculated by empirically or experimentally obtaining the outer radius R2 and the coiling number N when the length L0, the coil inner radius R1, and the thickness t are already known.

Further, based on the radius of curvature R as a function of the distance L1, the irradiation of laser beam is conducted in the following manner.

(a) The laser beam irradiation apparatus 2 is placed on the upstream side and/the downstream side of the annealing furnace 3.

(b) A transferring speed and a passage distance (which corresponds to the distance L1 from the front edge in the transferring direction) of the silicon steel sheet 1 at a point at which the laser beam is irradiated, are measured by a line speed monitoring apparatus and an irradiation position monitoring apparatus.

(c) Based on the sheet transfer speed of the silicon steel sheet 1, the distance L1 from the front edge, and the scanning rate Vc of laser beam, setting is conducted so that the irradiation interval PL on the surface of the silicon steel sheet 1 satisfies the expression (4), preferably the expression (5). Further, the irradiation energy density, and the local power density and the like of laser beam are also set.

(d) The irradiation of laser beam is performed.

As described above, the irradiation interval PL can be adjusted in accordance with the radius of curvature R. Incidentally, the irradiation interval PL may be fixed within a range of satisfying the expression (4), preferably the expression (5). When the adjustment as described above is conducted, as a point in the steel sheet coil 31 approaches the outer periphery of the coil, the irradiation interval PL at that point is increased, so that when compared to a case where the irradiation interval PL is fixed, it is possible to reduce an average power of irradiation of laser.

Next, explanation will be made on conditions of the irradiation of laser beam. From an experiment described below, the present inventors found out that when the irradiation energy density Up of laser beam defined by an expression (6) satisfies an expression (7), a grain boundary along a path of laser beam is particularly properly formed.

$$Up=4/\pi\times P/(Dl\times Vc) \quad (6)$$

$$0.5\ \mathrm{J/mm^2}\leq Up\leq 20\ \mathrm{J/mm^2} \quad (7)$$

Here, P represents an intensity (W) of laser beam, Dl represents a size (mm) in the rolling direction of focused beam spot of laser beam, and Vc represents a scanning rate (mm/sec) of laser beam.

In this experiment, hot-rolling was first performed on a steel material for a grain-oriented electrical steel containing Si of 2 mass % to 4 mass %, so as to obtain a silicon steel sheet after the hot-rolling (hot-rolled steel sheet). Then, the silicon steel sheet was annealed at about 1100° C. Thereafter, cold-rolling was performed to set a thickness of the silicon steel sheet to 0.23 mm, and the resultant was coiled to have a cold-rolled coil. Subsequently, from the cold-rolled coil, single-plate samples each having a width in the C direction of 100 mm and a length in the rolling direction (L direction) of 500 mm were cut out. Then, on a surface of each of the single-plate samples, laser beams were irradiated while being scanned in the sheet width direction. Conditions for them are presented in Table 1. Thereafter, a decarburization annealing was conducted at 700° C. to 900° C. to cause a primary recrystallization. Subsequently, the single-plate samples were cooled to about room temperature, and thereafter, an annealing separating agent containing MgO as its major constituent was coated on the surfaces of each of the single-plate samples. Then, a finish annealing at about 1200° C. for about 20 hours was conducted so as to cause a secondary recrystallization.

Further, an evaluation regarding the presence/absence of grain boundaries along paths of laser beams, and the presence/absence of melting and deformation of the surface of each of the single-plate samples being a base material, were conducted. Incidentally, in the evaluation regarding the presence/absence of the grain boundaries along the paths of laser beams, an observation of picture of a cross section of each of the single-plate samples orthogonal to the sheet width direction was conducted. Further, regarding the presence/absence of the melting and deformation of the surface, an observation of the surface of each of the single-plate samples after the removal of glass film formed during the finish annealing and the performance of pickling, was conducted. Results of these are also presented in Table 1.

TABLE 1

| SAMPLE No. | P (W) | Vc (mm/s) | Dl (mm) | Dc (mm) | Up (J/mm$^2$) | GRAIN BOUNDARIES ALONG PATHS | MELTING, DEFORMATION AT SURFACE |
|---|---|---|---|---|---|---|---|
| 1 | 500 | 15000 | 0.1 | 5 | 0.4 | ABSENT | ABSENT |
| 2 | 500 | 10000 | 0.1 | 5 | 0.5 | PRESENT | ABSENT |
| 3 | 500 | 5000 | 0.1 | 5 | 1.3 | PRESENT | ABSENT |
| 4 | 500 | 2000 | 0.1 | 5 | 3.2 | PRESENT | ABSENT |
| 5 | 500 | 1000 | 0.1 | 5 | 6.4 | PRESENT | ABSENT |
| 6 | 500 | 500 | 0.1 | 5 | 12.7 | PRESENT | ABSENT |
| 7 | 500 | 300 | 0.1 | 5 | 21.2 | PRESENT | PRESENT |
| 8 | 2000 | 400 | 1 | 10 | 6.4 | PRESENT | ABSENT |
| 9 | 500 | 400 | 0.05 | 10 | 12.7 | PRESENT | ABSENT |

As presented in Table 1, in a sample No. 1, in which the irradiation energy density Up was less than 0.5 J/mm$^2$, the grain boundaries along the paths of laser beams were not formed. It can be considered that this is because, since a sufficient heat quantity was not provided, a variation in local distortion strength and a variation in a size of crystal grain obtained through the primary recrystallization did not occur almost at all. Further, in a sample No. 7, in which the irradiation energy density Up exceeded 20 J/mm$^2$, although the grain boundaries along the paths of laser beams were formed, the deformation and/or a trace of melting caused by the irradiation of laser beams existed on the surface of the single-plate sample (the base material of steel). When the grain-oriented electrical steel sheets are stacked to be used, the deformation and/or the trace of melting as above reduce(s) a space factor and generate(s) stress and deformation, which leads to the reduction in the magnetic properties.

Meanwhile, in samples No. 2 to No. 6 and samples No. 8 and No. 9, in which the expression (7) was satisfied, the grain boundaries along the paths of laser beams were properly formed, regardless of the shape of focused beam spot of laser beam, the scanning rate, and the intensity of laser beam. Further, no deformation and trace of melting caused by the irradiation of laser beam existed.

From such an experiment, it can be said that the irradiation energy density Up of laser beam defined by the expression (6) preferably satisfies the expression (7).

Incidentally, a similar result was obtained also when the irradiation of laser beam was performed between the decarburization annealing and the finish annealing. Therefore, also in this case, it is preferable that the irradiation energy density Up satisfies the expression (7). Further, also when the irradiation of laser beam is conducted before and after the decarburization annealing, the irradiation energy density Up preferably satisfies the expression (7).

Further, in order to prevent the occurrence of deformation and melting of the silicon steel sheet (the base material of steel) caused by the irradiation of laser beam, it is preferable that the local power density Ip of laser defined by an expression (8) satisfies an expression (9).

$$Ip=4/\pi\times P/(Dl\times Dc) \quad (8)$$

$$Ip\leq 100\ \text{kW/mm}^2 \quad (9)$$

Here, Dc represents the size (mm) in the sheet width direction of the focused beam spot of laser beam.

The larger the local power density Ip, the higher the chance of occurrence of melting, scattering, and vaporization of the silicon steel sheet, and when the local power density Ip exceeds 100 kW/mm$^2$, a hole, a groove or the like is likely to be formed on the surface of the silicon steel sheet.

Further, when comparing a pulse laser and a continuous wave laser, a groove or the like is likely to be formed when the pulse laser is used, even if the same local power density Ip is employed. This is because, when a pulse laser is used, a sudden change in temperature easily occurs at a region to which the laser beam is irradiated. Therefore, it is preferable to use a continuous wave laser.

The same applies to a case where the irradiation of laser beam is conducted between the decarburization annealing and the finish annealing, and a case where the irradiation of laser beam is conducted before and after the decarburization annealing.

Figure 1A:
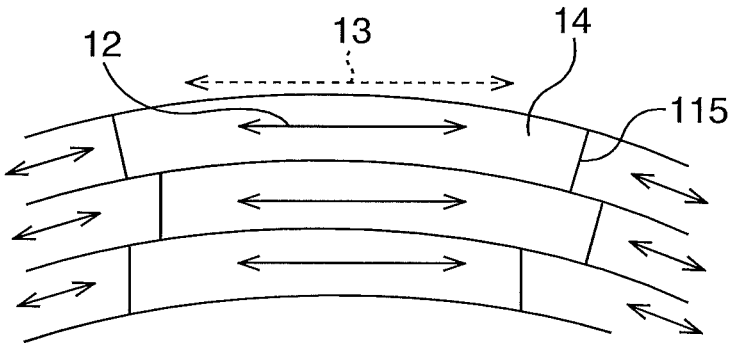
FIG. 1A is a diagram illustrating orientations of crystal grains obtained through a secondary recrystallization.
Figure 1B:
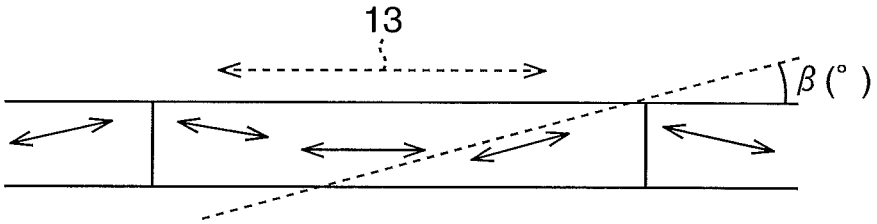
FIG. 1B is a diagram illustrating crystal grains after flattening.

As described above, when the steel sheet coil of the silicon steel sheet after the occurrence of primary recrystallization is annealed to cause the secondary recrystallization, a part is generated in the crystal grain obtained through the secondary recrystallization, in which the axis of easy magnetization is deviated from the rolling direction due to the influence of curvature, as illustrated in FIG. 1A and FIG. 1B. Further, the larger the size of the crystal grains in the rolling direction and the smaller the radius of curvature, the more noticeable the degree of the deviation. Further, since the size in the rolling direction as above is not particularly controlled in the conventional technique, there is a case where the angle deviation β being one of indexes for representing the degree of deviation described above reaches 10° or more. On the contrary, according to the embodiment described above, the proper irradiation of laser beam is conducted, and the grain boundaries passing from the front surface to the rear surface of the silicon steel sheet beneath the paths of laser beams are generated during the secondary recrystallization, so that the size of each crystal grain in the rolling direction is preferable. Therefore, when compared to a case where the irradiation of laser beam is not conducted, it is possible to reduce the angle deviation β and improve the orientation of crystal orientation to obtain a high magnetic flux density $B_8$ and a low iron loss $W_{17/50}$.

Further, the irradiation of laser beam may be performed at high speed, and the laser beam can be focused into a very small space to obtain a high energy density, so that an influence on a production time due to the laser processing is small, when compared to a case where the irradiation of laser beam is not conducted. In other words, the transferring speed in the processing of performing the decarburization annealing while uncoiling the cold-rolled coil and the like, does not have to be changed almost at all, regardless of the presence/absence of the irradiation of laser beam. Further, since the temperature at the time of performing the irradiation of laser beam is not particularly limited, a heat insulating apparatus or the like for the laser irradiation apparatus is not required. Therefore, it is possible to simplify the structure of the facility, when compared to a case where a processing in a high-temperature furnace is required.

Incidentally, an irradiation of laser beam may be performed for the purpose of refining a magnetic domain after the formation of the insulating film.

EXAMPLE (First Experiment)

In a first experiment, a steel material for a grain-oriented electrical steel containing Si of 3 mass % was hot-rolled, so as to obtain a silicon steel sheet after the hot-rolling (hot-rolled steel sheet). Then, the silicon steel sheet was annealed at about 1100° C. Thereafter, cold-rolling was conducted so as to make a thickness of the silicon steel sheet 0.23 mm, and the resultant was coiled to have a cold-rolled coil. Incidentally, the number of produced cold-rolled coils was four. Subsequently, an irradiation of laser beam was performed on three cold-rolled coils (coils Nos. C1 to C3), and after that, a decarburization annealing was conducted to cause a primary recrystallization. Regarding the remaining one cold-rolled coil (coil No. C4), no irradiation of laser beam was conducted, and after that, the decarburization annealing was conducted to cause the primary recrystallization.

After the decarburization annealing, a coating of an annealing separating agent, and a finish annealing under the same condition were performed on these silicon steel sheets.

Figure 9A:
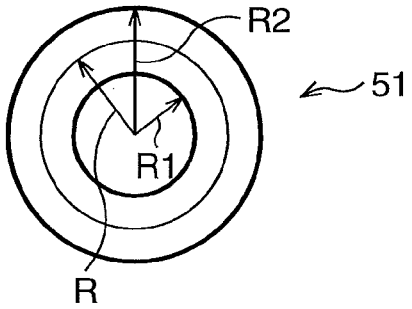
FIG. 9A is a diagram illustrating a relation among a radius of curvature R, an inner radius R1 and an outer radius R2.

Here, explanation will be made on the irradiation interval PL of laser beam in the coils Nos. C1 to C3, while referring to FIG. 9A to FIG. 9D. After the coating of the annealing separating agent, the silicon steel sheet was coiled to have a steel sheet coil 51 as illustrated in FIG. 9A, and the finish annealing was conducted under this state. In advance of making the steel sheet coil 51, an inner radius R1 of the steel sheet coil 51 was set to 310 mm. Further, a length LO in the rolling direction of the silicon steel sheet in the steel sheet coil 51 was equivalent to a length in the rolling direction of the silicon steel sheet after the cold-rolling, and was about 12000 m. Therefore, an outer radius R2 of the steel sheet coil 51 could be calculated from these, and was 1000 mm.

Figure 9B:
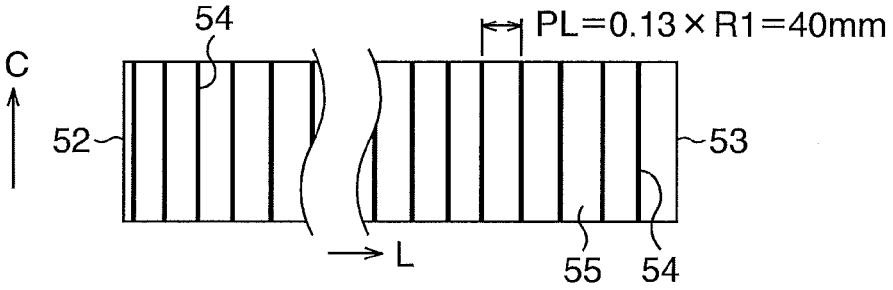
FIG. 9B is a diagram illustrating intervals of irradiation of laser beams with respect to a coil No. C1.

Further, in the irradiation of laser beam with respect to the coil No. C1, the irradiation interval PL was set to 40 mm, as illustrated in FIG. 9B. Specifically, the irradiation of laser beam was conducted with the same interval from a part corresponding to an inside edge 52 to a part corresponding to an outside edge 53 of the steel sheet coil 51, to leave paths 54 on a surface of a silicon steel sheet 55. Incidentally, the value of the irradiation interval PL (40 mm) in this processing is equivalent to the maximum value within a range which satisfies the expression (4) in relation to the inner radius R1 (310 mm) of the steel sheet coil 51. Therefore, the expression (4) is satisfied at each position of the silicon steel sheet 55.

Figure 9C:
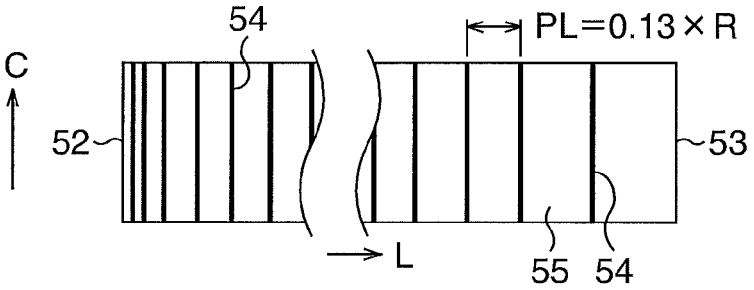
FIG. 9C is a diagram illustrating intervals of irradiation of laser beams with respect to a coil No. C2.

Further, in the irradiation of laser beam with respect to the coil No. C2, the irradiation interval PL was changed in accordance with a local radius of curvature R in the steel sheet coil 51, as illustrated in FIG. 9C. In other words, the irradiation of laser beam was conducted from a part corresponding to the inside edge 52 to a part corresponding to the outside edge 53 of the steel sheet coil 51 while gradually enlarging the irradiation interval PL to leave the paths 54 on the surface of the silicon steel sheet 55.

Figure 9D:
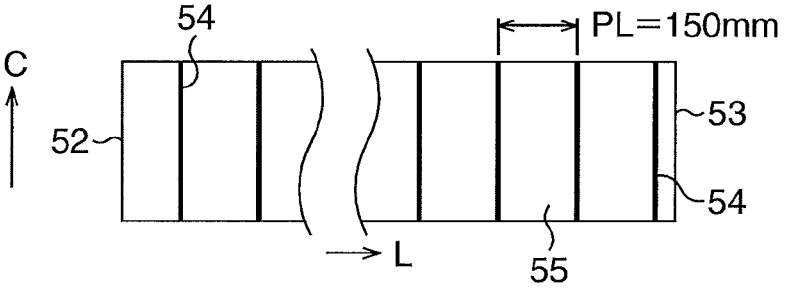
FIG. 9D is a diagram illustrating intervals of irradiation of laser beams with respect to a coil No. C3.

Further, in the irradiation of laser beam with respect to the coil No. C3, the irradiation interval PL was set to 150 mm, as illustrated in FIG. 9D. In other words, the irradiation of laser beam was conducted with the same interval from a part corresponding to the inside edge 52 to a part corresponding to the outside edge 53 of the steel sheet coil 51, to leave the paths 54 on the surface of the silicon steel sheet 55. Incidentally, the value of the irradiation interval PL (150 mm) in this processing is larger than the maximum value (130 mm) within a range of satisfying the expression (4) in relation to the outer radius R2 (1000 mm) of the steel sheet coil 51. Therefore, the expression (4) is not satisfied at any position of the silicon steel sheet 55.

Further, in the irradiation of laser beam with respect to the coils Nos. C1 to C3, the condition in which the irradiation energy density Up and the local power density Ip satisfy the expression (7) and the expression (9), was selected. As described above, no irradiation of laser beam was performed on the coil No. C4.

After the finish annealing, an annealing was performed for eliminating a curl, distortion and deformation occurred during the finish annealing, so as to flatten the silicon steel sheets 55. Further, an insulating film was formed on the surface of each of the silicon steel sheets 55. Thus, the four types of grain-oriented electrical steel sheets were manufactured.

Then, from each of the grain-oriented electrical steel sheets, ten samples were cut out at each of six positions indicated in Table 2 along the rolling direction by setting the inside edge 52 of the steel sheet coil 51 as a starting point. The magnetic flux density $B_8$, the iron loss $W_{17/50}$, and the maximum value of the angle deviation β of each sample were measured. The magnetic flux density $B_8$ and the iron loss $W_{17/50}$ were measured by a well-known measuring method with respect to electrical steel sheets. In the measurement of the maximum value of the angle deviation β, the X-ray Laue method was employed. Incidentally, the size of X-ray spot on the sample, namely, the spatial resolution in the X-ray Laue method was 1 mm. Results of these are also presented in Table 2. Note that each numerical value presented in Table 2 is an average value of the ten samples.

TABLE 2

| POSITION | COIL No. C1 | | | | COIL No. C2 | | | | COIL No. C3 | | | | COIL No. C4 | | |
|---|---|---|---|---|---|---|---|---|---|---|---|---|---|---|---|
| IN ROLLING DIRECTION (m) | PL (mm) | β (°) | $B_8$ (T) | $W_{17/50}$ (W/kg) | PL (mm) | β (°) | $B_8$ (T) | $W_{17/50}$ (W/kg) | PL (mm) | β (°) | $B_8$ (T) | $W_{17/50}$ (W/kg) | β (°) | $B_8$ (T) | $W_{17/50}$ (W/kg) |
| 10 | 40 | 7.2 | 1.904 | 0.77 | 41 | 7.1 | 1.910 | 0.77 | 150 | 13.0 | 1.850 | 0.85 | 13.5 | 1.840 | 0.86 |
| 2000 | 40 | 6.0 | 1.933 | 0.76 | 64 | 7.0 | 1.908 | 0.76 | 150 | 11.2 | 1.860 | 0.85 | 14.2 | 1.830 | 0.86 |
| 4000 | 40 | 4.6 | 1.936 | 0.76 | 81 | 6.9 | 1.913 | 0.75 | 150 | 10.5 | 1.870 | 0.86 | 15.1 | 1.829 | 0.88 |
| 6000 | 40 | 3.4 | 1.940 | 0.75 | 95 | 6.7 | 1.920 | 0.75 | 150 | 9.8 | 1.860 | 0.84 | 16.2 | 1.835 | 0.89 |
| 8000 | 40 | 2.5 | 1.942 | 0.75 | 107 | 6.9 | 1.916 | 0.76 | 150 | 9.6 | 1.860 | 0.83 | 17.0 | 1.845 | 0.90 |
| 12000 | 40 | 2.3 | 1.950 | 0.75 | 128 | 7.0 | 1.910 | 0.75 | 150 | 8.6 | 1.870 | 0.84 | 18.9 | 1.830 | 0.89 |

As presented in Table 2, in the coils Nos. C1 and C2, in which the expression (4) was satisfied, the maximum value of the angle deviation β was less than 7.3° at each position. For this reason, the magnetic flux density $B_8$ was significantly large and the iron loss $W_{17/50}$ was extremely low, when compared to the coil No. C4 (comparative example), in which no irradiation of laser beam was conducted. In short, the magnetic flux density $B_8$ of 1.90 T or more and the iron loss $W_{17/50}$ of 0.77 W/kg or less were stably obtained. Moreover, in the coil No. C2, the irradiation interval PL was adjusted in accordance with the radius of curvature R, so that more uniform magnetic properties were obtained.

Further, in the coil No. C3, in which the expression (4) was not satisfied, the magnetic flux density $B_8$ was large and the iron loss $W_{17/15}$ was low when compared to the coil No. C4 (comparative example), but the magnetic flux density $B_8$ was small and the iron loss $W_{17/50}$ was high when compared to the coils Nos. C1 and C2.

Further, regarding each sample cut out from the coils No. 1 to No. 3, a distribution of angle deviation β in a crystal grain was measured through the X-ray Laue method. As a result, it was confirmed that in a crystal grain between two grain boundaries formed along the paths of laser beams, the angle deviation β is large in a region closer to either of the grain boundaries. Generally, a position resolution in the measurement with the X-ray Laue method is 1 mm, and a position resolution in this measurement was also −1 mm.

From the first experiment as described above, it was proved that when the angle deviation β at the position separated by 1 mm from the grain boundary formed along the path of laser beam is 7.3° or less, it is possible to improve the matching degree of crystal orientation to obtain the magnetic flux density $B_8$ of 1.90 T or more.

(Second Experiment)

In a second experiment, cold-rolled coils were first produced in a similar manner to the first experiment. Incidentally, the number of produced cold-rolled coils was five. Subsequently, regarding four cold-rolled coils, the irradiation of laser beam was conducted by differentiating the irradiation intervals PL as presented in Table 3, and after that, the decarburization annealing was conducted to cause the primary recrystallization. Regarding the remaining one cold-rolled coil, no irradiation of laser beam was conducted, and after that, the decarburization annealing was conducted to cause the primary recrystallization.

After the decarburization annealing, the coating of the annealing separating agent, and the finish annealing under the same condition were performed on these silicon steel sheets. Further, an annealing was performed for eliminating a curl, distortion and deformation occurred during the finish annealing, so as to flatten the silicon steel sheets. Further, an insulating film was formed on the surface of each of the silicon steel sheets. Thus, the five types of grain-oriented electrical steel sheets were manufactured.

Then, a sample was cut out from a part corresponding to the inside edge of the steel sheet coil (R1=310mm) of each grain-oriented electrical steel sheet, and the magnetic flux density $B_8$ and the iron loss $W_{17/50}$ of each sample were measured. Results thereof are also presented in Table 3.

[Table 3]

TABLE 3

| SAMPLE No. | GRAIN BOUNDARIES ALONG PATHS | PL (mm) | $B_8$ (T) | $W_{17/50}$ (W/kg) |
|---|---|---|---|---|
| 10 | ABSENT | — | 1.880 | 0.830 |
| 11 | PRESENT | 1 | 1.890 | 0.825 |
| 12 | PRESENT | 2 | 1.915 | 0.760 |
| 13 | PRESENT | 5 | 1.935 | 0.750 |
| 14 | PRESENT | 10 | 1.940 | 0.730 |

As presented in Table 3, in samples No. 10 and No. 11, in which the irradiation interval PL was less than 2 mm, the magnetic flux density $B_8$ was low to be less than 1.90 T, and the iron loss $W_{17/50}$ was high to be 0.8 W/kg or more. In short, the magnetic properties were deteriorated, when compared to samples No. 12 to No. 14, in which the irradiation interval PL was 2 mm or more. It can be estimated that this is because when the irradiation interval PL is extremely small, a size in the rolling direction of crystal grain between two grain boundaries is too small so that an influence of very small distortion occurred by the irradiation of laser beam becomes relatively large. In other words, it can be estimated that this is because, although the angle deviation β becomes small, a hysteresis loss of the silicon steel sheet is increased and the magnetic properties become difficult to be improved. Therefore, it is preferable to set a lower limit value of the range of the irradiation interval PL to 2 mm, regardless of the radius of curvature R.

INDUSTRIAL APPLICABILITY

The present invention may be utilized in an industry of manufacturing electrical steel sheets and an industry of utilizing electrical steel sheets, for example.

The invention claimed is:

1. A manufacturing method of a grain-oriented electrical steel sheet, comprising:

cold-rolling a silicon steel sheet containing Si;

next, performing a decarburization annealing of the silicon steel sheet so as to cause a primary recrystallization;

next, coiling the silicon steel sheet so as to obtain a steel sheet coil;

next, performing an annealing of the steel sheet coil through batch processing so as to cause a secondary recrystallization; and next, uncoiling and flattening the steel sheet coil, wherein the manufacturing method further comprising, between the cold-rolling the silicon steel sheet containing Si and the coiling the silicon steel sheet so as to obtain the steel sheet coil, irradiating a laser beam a plurality of times at a predetermined interval in a rolling direction on a surface of the silicon steel sheet from one end to the other end of the silicon steel sheet along a sheet width direction, and while the secondary recrystallization is caused, grain boundaries passing from a front surface to a rear surface of the silicon steel sheet are generated along paths of the laser beams, wherein, when an average intensity of the laser beam is P (W), a size in the rolling direction and a size in the sheet width direction of a focused beam spot of the laser beam are Dl (mm) and Dc (mm), respectively, and a local power density of the laser beam is $Ip=4/\pi\times P/(Dl\times Dc)$, the following relation is satisfied, $$Ip\leq 100\text{kW/mm}^2.$$

2. The manufacturing method of a grain-oriented electrical steel sheet according to claim 1, wherein a part of the surface of the silicon steel sheet to which the laser beam has been irradiated is flat.

3. The manufacturing method of a grain-oriented electrical steel sheet according to claim 1, wherein, when a radius of curvature at an arbitrary position in the silicon steel sheet in the steel sheet coil is R (mm) and the predetermined interval at the position is PL (mm), the following relation is satisfied, $$PL\leq 0.13\times R.$$

4. The manufacturing method of a grain-oriented electrical steel sheet according to claim 3, wherein the predetermined interval is fixed.

5. The manufacturing method of a grain-oriented electrical steel sheet according to claim 3, wherein the predetermined interval is wider as the position approaches from an inner surface toward an outer surface of the steel sheet coil.

6. The manufacturing method of a grain-oriented electrical steel sheet according to claim 1, wherein the predetermined interval is 2 mm or more.

* * * * *